United States Patent [19]

Slone

[11] 4,100,631

[45] Jul. 18, 1978

[54] BOX-SPRING ASSEMBLY

[76] Inventor: Norman Slone, 3954-626 Water Oak Rd., Virginia Beach, Va. 23452

[21] Appl. No.: 685,781

[22] Filed: May 13, 1976

[51] Int. Cl.[2] ..... A47C 23/05

[52] U.S. Cl. ..... 5/239; 5/247; 5/248

[58] Field of Search ..... 5/239, 243, 247, 248, 5/246, 255

[56] References Cited

U.S. PATENT DOCUMENTS

| | | | |
|---|---|---|---|
| 54,737 | 5/1866 | Jones | 5/239 |
| 65,731 | 6/1867 | Dow | 5/239 |
| 67,585 | 8/1867 | Robbins | 5/239 |
| 73,755 | 1/1868 | Rear | 5/248 |
| 91,913 | 6/1869 | Collins | 5/239 |
| 113,596 | 4/1871 | Tinney | 5/239 |
| 206,735 | 8/1878 | Johnson et al. | 5/239 |
| 210,508 | 12/1878 | Eade | 5/239 |
| 256,676 | 4/1882 | Hale | 5/239 |
| 318,219 | 5/1885 | Taylor | 5/239 |
| 3,085,259 | 4/1963 | Sandor | 5/247 |
| 3,546,723 | 12/1970 | Ciampa et al. | 5/247 |

*Primary Examiner*—Casmir A. Nunberg
*Assistant Examiner*—Victor N. Sakran

[57] ABSTRACT

This invention consists of a low cost box-spring assembly for use on a conventional bed frame under the mattress to provide comfort and additional resiliency as weight is placed upon the mattress.

7 Claims, 5 Drawing Figures

BOX-SPRING ASSEMBLY

BACKGROUND AND OBJECTIVES OF THE INVENTION

Conventional household beds utilize box-springs under the mattress to provide the mattress with additional support and resiliency. The box-springs heretofore used have been constructed of a series of wire coil springs in rows individually joined to each other or to framing members generally rectangularly shaped, and often covered with a thin fabric.

Often times, after conventional box-springs have been subjected to substantial usage, the individual coil springs will become separated from the frame and poke through the thin fabric covering, thereby damaging the under side of the mattress. Also, conventional box-springs are generally heavy, unwieldy and expensive due to the vast number of coil springs which are required to provide even support for the mattress, and due in part to the large amount of heavy metal that is employed in their construction.

With the disadvantages of conventional box-springs known, the present concept was developed and one of its objectives is to provide a box-spring assembly of relatively low cost.

It is yet another object of this invention to provide a box spring assembly with a relatively few in number resilient elements when compared to conventional box-springs.

It is a further object of the present invention to provide a box-spring assembly that is more easily handled and lighter in weight.

It is still another object of the present invention to provide a box-spring assembly with rigid support members that prevent the individual springs from becoming free and damaging the mattress positioned thereon.

DESCRIPTION OF THE DRAWINGS AND PREFERRED EMBODIMENT

The present invention relates to a box-spring assembly constructed of pairs of longitudinal members of wood or other suitable material having springs or other resilient members therebetween. Generally, three such pairs of wooden members are used and are joined together by transverse braces although a greater number of pairs may be employed. Cross or transverse braces extend between the outer pairs of longitudinal members and are securely fastened thereto. The transverse braces may likewise be made of wood or other materials and can join the longitudinal slats or members either on the top, bottom or on both the top and bottom of the longitudinal members.

The longitudinal members or slats prevent the springs from damaging the underside of the mattress due to their thickness and ability to withstand the impact from the springs and can be provided with slots or holes for access to the springs to aid in manufacturing or repairing.

Turning now to the drawings.

Figure 5:
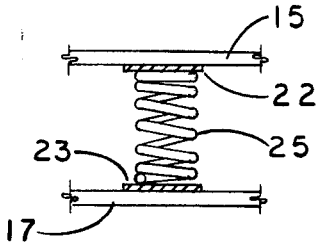

FIG. 5 demonstrates yet another partial cross sectional view of the box-spring assembly utilizing a helical coil spring.

Figure 1:
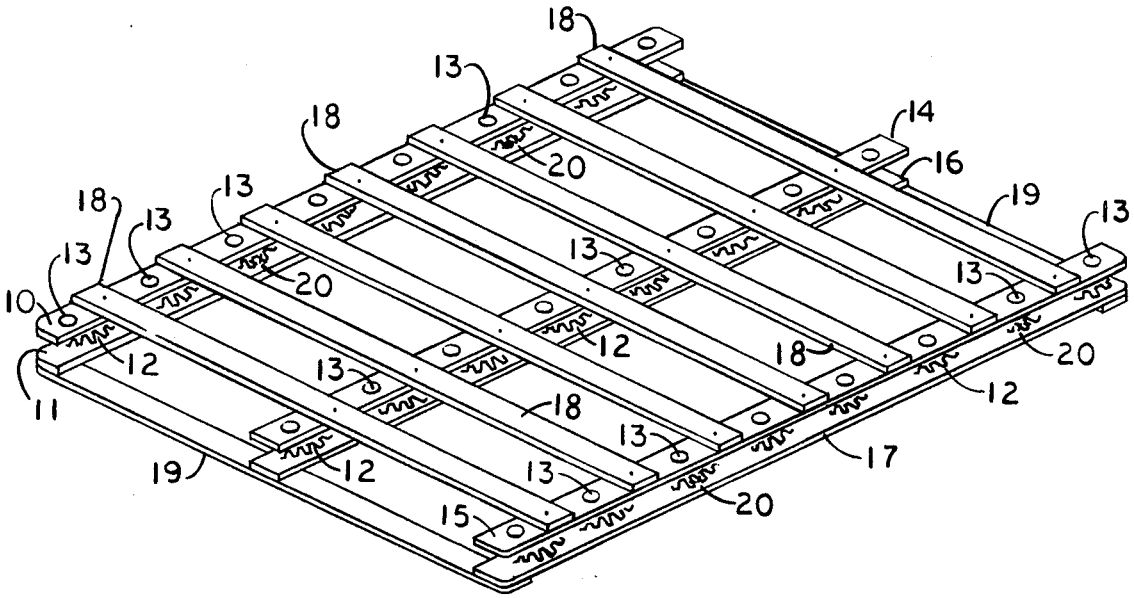
FIG. 1 is a top plan view of the preferred embodiment of the box-spring assembly encompassed in the present invention.

For a more detailed description of the invention, referring to FIG. 1, left side top longitudinal member 10 is shown positioned above left side bottom longitudinal member 11 and therebetween is connected sinuous spring 12. Apertures 13 are shown in the top longitudinal members 10, 14 and 15 for providing access to sinuous springs 12.

Intermediate longitudinal support members 14 and 16 are shown positioned midway between longitudinally extending side support members 10, 11, 15, and 17. Intermediate support members 14 and 16 are rigidly spaced from the longitudinally extending side support members by top transverse brace members 18 and bottom transverse brace members 19 to form a rectangularly shaped box-spring assembly.

A box-spring assembly as shown in FIG. 1 may be enclosed in a thin fabric or other covering (not shown), should the covering be thought to add to the aesthetic quality and salability of the product.

Both the longitudinally extending members and the transverse members are constructed from suitable materials such as pine or fir, though other materials such as plywood, particle board, metals or plastics may be used. Hardwoods such as oak and hickory could be utilized, but due to their increased weight and cost, such woods are not nearly as desirable as the lighter and more economical woods such as pine.

Figure 2:
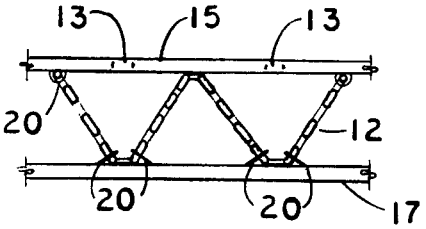
FIG. 2 is a cross sectional view of the preferred embodiment incorporating a sinuous spring.

In FIG. 2, sinuous spring 12 is shown positioned between longitudinal members 15 and 17. Access holes 13 are shown schematically and are used to provide access to insert staples 20 to rigidly affix sinuous spring 12 to longitudinal support member 17.

Figure 3:
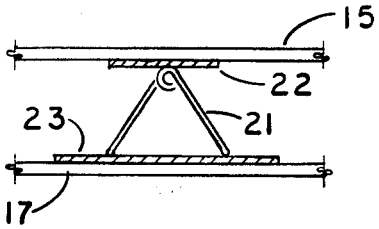
FIG. 3 illustrates a cross sectional view incorporating another type of wire spring member.

In FIG. 3, spring member 21 is shown positioned between guard plates 22 and 23. As spring 21 flexes due to the forces applied to longitudinal support member 15, guard plates 22 and 23 prevent spring member 21 from penetrating longitudinal support members 15 and 17 for example, in the event longitudinal members 15 and 17 are made of soft pine. Guard plates 22 and 23 can be constructed of metal, plastic or hardwoods and are designed to receive the impact without noticable effect or damage as weight is applied to the mattress (not shown) positioned on the box-spring assembly.

Figure 4:
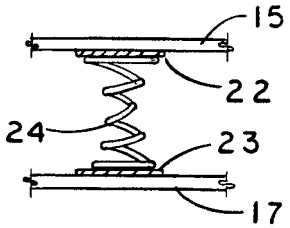
FIG. 4 depicts a cross sectional view with an hour-glass coil spring.

In FIG. 4 another embodiment of a resilient member is shown by "hour-glass" coil spring 24. This embodiment is also shown with guard plate 22 protecting longitudinal support member 15 and guard plate 23 protecting longitudinal member support 17 when weight or force is applied to spring member 24 through longitudinal support member 15.

In FIG. 5 helical coil spring 25 is shown positioned between longitudinal support members 15 and 17. Guard plates 22 and 23 are shown in FIG. 5 as they would be positioned to protect longitudinal support members 15 and 17, respectively.

As can be seen from the drawing, the box-spring assembly of the present invention is relatively simple to assemble while providing the maximum support and resiliency needed for the mattress at an economical cost.

Additionally, the box-spring construction of the present invention has high versitality and may be adapted to a variety of resilient members, such as the various springs shown, and also natural and synthetic foam rubber.

Various modifications and changes should be readily apparent to those skilled in the box-spring art, and various embodiments or changes will not deviate from the concept of the present invention.

I claim:

1. A box-spring assembly for use with a conventional bed frame for cooperatively receiving a mattress comprising two pairs of longitudinally extending side support members and at least one pair of intermediate support members, said pairs of support member being spacially aligned and having a top and bottom portion with resilient means therebetween, each resilient means being spaced from said support members by independent upper and lower guard means, said guard means having a hardness greater than said support member, said guard member having sufficient area dimensions to protect said support member when said resilient member is in its compressed configuration, said top portion includes a series of apertures for access to said resilient means, a plurality of transverse bracing members connected to said pairs of support members to maintain spacial alignment of said support members whereby the weight from a mattress placed thereon will be evenly distributed.

2. A box-spring assembly as claimed in claim 1, wherein said transverse bracing members comprise two bracing members connected to opposite ends of the bottom portion of said side support members.

3. A box-spring assembly as claimed in claim 2, wherein said transverse bracing members include seven transverse bracing members equally spaced and connected to the top portion of said side support members.

4. A box-spring assembly as claimed in claim 1, wherein said resilient means comprises spring means.

5. A box-spring assembly as claimed in claim 4, wherein said spring means comprises coil spring means.

6. A box-spring assembly as claimed in Claim 4, wherein said spring means comprises a sinuous spring means.

7. A box-spring assembly as claimed in claim 1, wherein said resilient means comprises synthetic foam means.

* * * * *